US008525732B2

(12) United States Patent
Utagawa et al.

(10) Patent No.: US 8,525,732 B2
(45) Date of Patent: Sep. 3, 2013

(54) ANTENNA DEVICE

(75) Inventors: Naoaki Utagawa, Tokyo (JP); Kei Suzuki, Tokyo (JP); Yasumasa Harihara, Tokyo (JP); Masaki Matsushima, Tokyo (JP); Takeshi Ohashi, Tokyo (JP)

(73) Assignee: TDK Corporation, Tokyo (JP)

( * ) Notice: Subject to any disclaimer, the term of this patent is extended or adjusted under 35 U.S.C. 154(b) by 231 days.

(21) Appl. No.: 12/963,083

(22) Filed: Dec. 8, 2010

(65) Prior Publication Data

US 2011/0133993 A1 Jun. 9, 2011

(30) Foreign Application Priority Data

Dec. 9, 2009 (JP) ..... 2009-279272

(51) Int. Cl.
*H01Q 1/38* (2006.01)

(52) U.S. Cl.
USPC ..... 343/700 MS; 343/702

(58) Field of Classification Search
USPC ..... 343/700 MS, 702, 846
See application file for complete search history.

(56) References Cited

U.S. PATENT DOCUMENTS

| | | | | |
|---|---|---|---|---|
| 6,300,909 | B1 * | 10/2001 | Tsubaki et al. | 343/700 MS |
| 6,614,398 | B2 * | 9/2003 | Kushihi et al. | 343/700 MS |
| 7,319,431 | B2 * | 1/2008 | Jeon et al. | 343/700 MS |
| 7,538,732 | B2 * | 5/2009 | Ishihara et al. | 343/702 |
| 2001/0040527 | A1 | 11/2001 | Nagumo et al. | |
| 2002/0145569 | A1 | 10/2002 | Onaka et al. | |
| 2007/0040749 | A1 | 2/2007 | Jeon et al. | |
| 2009/0040120 | A1 | 2/2009 | Tsubaki et al. | |
| 2009/0179815 | A1 | 7/2009 | Sotoma et al. | |
| 2010/0225542 | A1 | 9/2010 | Suzuki et al. | |

FOREIGN PATENT DOCUMENTS

| | | | |
|---|---|---|---|
| CN | 101432928 | A | 5/2009 |
| EP | 2 226 891 | A1 | 9/2010 |
| JP | 10-013138 | | 1/1998 |
| JP | 2001-284954 | A | 10/2001 |
| JP | 2002-314330 | A | 10/2002 |
| JP | 2006-340368 | A | 12/2006 |
| JP | 2009-171096 | A | 7/2009 |

OTHER PUBLICATIONS

European Search Report issued in European Patent Application No. 10015443.4-2220, mailed Mar. 14, 2011.

* cited by examiner

*Primary Examiner* — Tan Ho
(74) *Attorney, Agent, or Firm* — McDermott Will & Emery LLP

(57) ABSTRACT

A radiation electrode 132 is printed on the upper surface of the dielectric body, side surface thereof, and bottom surface thereof in a folded configuration. A feeding electrode 130 and ground electrode 134 are printed on the bottom surface of the antenna elements 124. The feeding electrode 130 and radiation electrode 132 on the upper surface are opposed to each other as parallel planes. The ground electrode 134 and radiation electrode 132 are also opposite to each other as parallel planes. No electrode is formed on one of the side surfaces of the antenna element 124 that is opposed to the side surface at the side of which the radiation electrode 132 is folded.

4 Claims, 13 Drawing Sheets

101

124

105

102

ANTENNA DEVICE

BACKGROUND OF THE INVENTION

1. Field of the Invention

The present invention relates to an antenna device and, more particularly, to a technique for adjusting antenna characteristics.

2. Description of Related Art

A chip-like antenna element incorporated in a small radio terminal such as a mobile phone is formed by printing a radiation electrode and a feeding electrode on the surface of a block dielectric body. The radiation electrode and feeding electrode are capacitively coupled to each other through a gap (hereinafter, referred to as "feeding gap"). When AC current is fed to the feeding electrode to generate an electric field, the AC current flows also in the radiation electrode and thereby radio waves are generated from the radiation electrode.

CITATION LIST

Patent Document

[Patent Document 1] Jpn. Pat. Appln. Laid-Open Publication No. 10-13138

Antenna characteristics such as resonance frequency and impedance change depending on the capacitance of the feeding gap (hereinafter, referred to as "feeding coupling capacitance"). Typically, the feeding gap is often formed on the upper surface or side surface of a dielectric body (refer to, e.g., Patent Document 1). In this case, it is necessary to reduce the width of the feeding gap in order to increase the feeding coupling capacitance. However, with the current fabrication technology (thick film electrode printing technology), it is difficult to reduce the width of the feeding gap to 0.3 mm or less.

The present invention has been made in view of the above problem, and a main object thereof is to realize an antenna device capable of easily adjusting its antenna characteristics and capable of being easily manufactured.

SUMMARY

An antenna device according to the present invention includes an antenna element and a printed board. The antenna element has a dielectric body having substantially a rectangular solid shape, on the surface of which a radiation electrode, a feeding electrode, and a ground electrode are printed. The printed board includes a mounting area in which the antenna element is mounted and a ground pattern area formed around the mounting area. Both the feeding electrode and ground electrode are formed only on the bottom surface of the dielectric body. The radiation electrode is formed on the upper surface of the dielectric body, a first side surface thereof, and bottom surface thereof in a folded configuration. A second side surface opposite to the first side surface is configured as a non-electrode formation area.

The surface on which the feeding electrode is formed is opposite to the upper surface on which the radiation electrode is formed across the dielectric body. A capacitance is formed through the dielectric body, so that it is easy to increase feeding coupling capacitance formed between the feeding electrode and radiation electrode. The same can be said for a capacitance (hereinafter, referred to as "ground coupling capacitance") formed between the ground electrode and radiation electrode. Further, by changing the area of the feeding electrode, ground electrode, or radiation electrode, the ground coupling electrode or feeding electrode is changed to change antenna characteristics such as resonance frequency or impedance, making it easy to adjust the antenna characteristics.

Both or one of third and fourth side surfaces adjacent to the first and second side surfaces may be configured as a non-electrode formation area. Alternatively, apart of the radiation electrode may be formed on the upper part of both or one of the third and fourth side surfaces adjacent to the first and second side surfaces.

The radiation electrode may be formed on the entirety of the upper surface. The radiation electrode may be formed on the entirety of the first side surface. This configuration simplifies the electrode pattern of the antenna device, enhancing manufacturability.

The ground electrode may be formed as to be opposed to the radiation electrode with a gap having a predetermined width interposed therebetween on the bottom surface.

It is to be noted that any arbitrary combination of the above-described structural components and expressions changed between an apparatus, a system, etc. are all effective as and encompassed by the present embodiments.

The present invention is effective for realizing an antenna device capable of easily adjusting antenna characteristics and capable of being easily manufactured.

BRIEF DESCRIPTION OF THE DRAWINGS

The above features and advantages of the present invention will be more apparent from the following description of certain preferred embodiments taken in conjunction with the accompanying drawings, in which.

DETAILED DESCRIPTION OF THE EMBODIMENTS

Preferred embodiments of the present invention will be described with reference to the accompanying drawings. In the following embodiments, an antenna element incorporated in a mobile phone is used as an example. An antenna device is formed as a mobile phone incorporating the antenna element.

Figure 1:
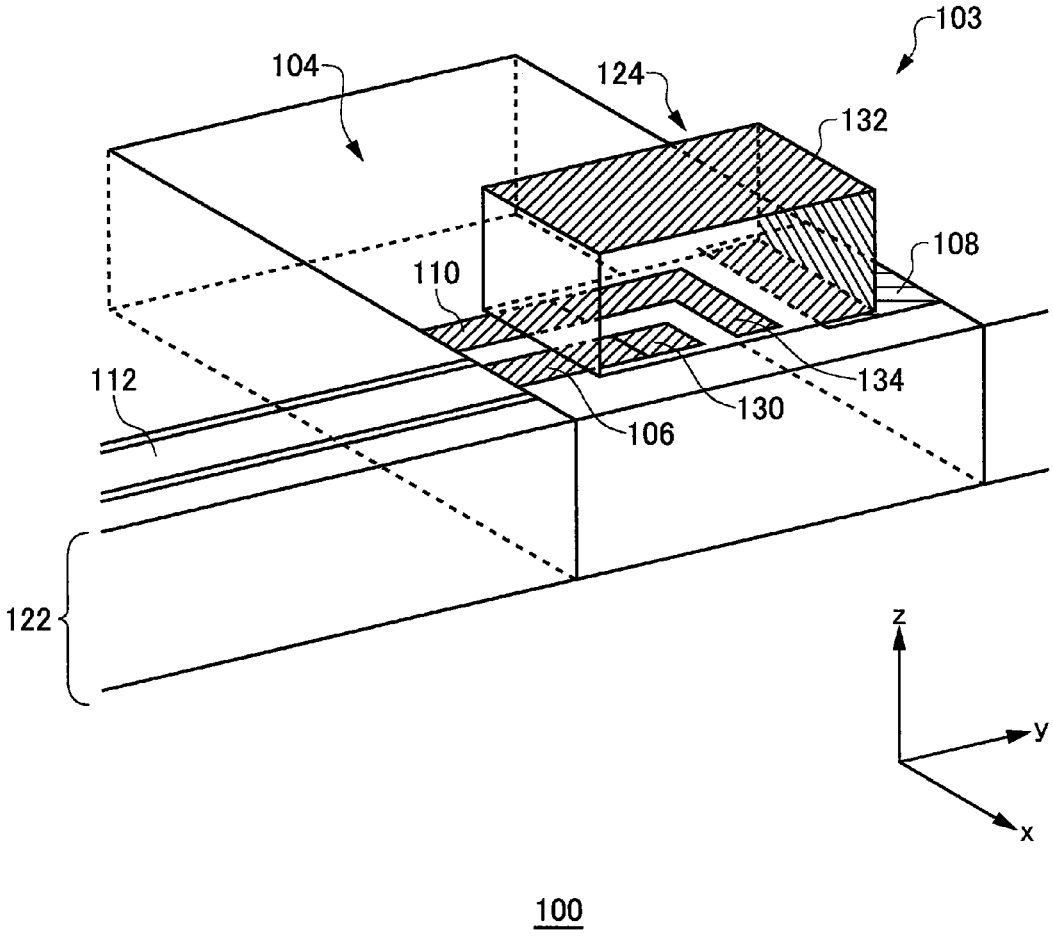
FIG. 1 is a view illustrating an outer appearance of an antenna device in a first embodiment of the present invention.

FIG. 1 is a view illustrating an outer appearance of an antenna device 100 in a first embodiment of the present invention. The antenna device 100 is formed by mounting an antenna element 124 on a printed board 122 of the mobile phone. As illustrated in FIG. 1, x-axis is set along the short length direction of the antenna element 124, y-axis is set along the longitudinal direction thereof, and z-axis is set along the thickness direction thereof.

The printed board 122 has a rectangular plate-like shape of a size of 40 mm×100 mm (x×y). The printed board 122 includes a ground pattern area 103 formed on substantially the entire surface of the printed board and a mounting area 104 formed at a part of the same. The mounting area 104 is formed at a peripheral portion of the printed board 122 such as a side portion or a corner portion. More specifically, in the present embodiment, the mounting area 104 is formed at the center of the long side portion of the printed board 122 (refer also to FIG. 12). The size of the mounting area 104 is 5.0 mm×3.0 mm (x×y). The x-direction length of the mounting area 104 is preferably 1.5 times or more longer than the y-direction length of the same.

The resonance frequency of the antenna device 100 is set to about 2.45 GHz which is the frequency band of Bluetooth®. The size of the antenna element 124 is 1.25 mm×2.0 mm×0.8 mm (x×y×z).

There are formed in the mounting area 104 three electrode patterns: a feeding pattern 106; a first ground electrode connection pattern 108; and a second ground electrode connection pattern 110. The feeding pattern 106 receives AC power through a feeding line 112 which is a transmission line having a characteristic impedance of 50Ω. The antenna element 124 is bonded onto these patterns. That is, all or some of these patterns function as a land of the antenna element 124.

Figure 2:
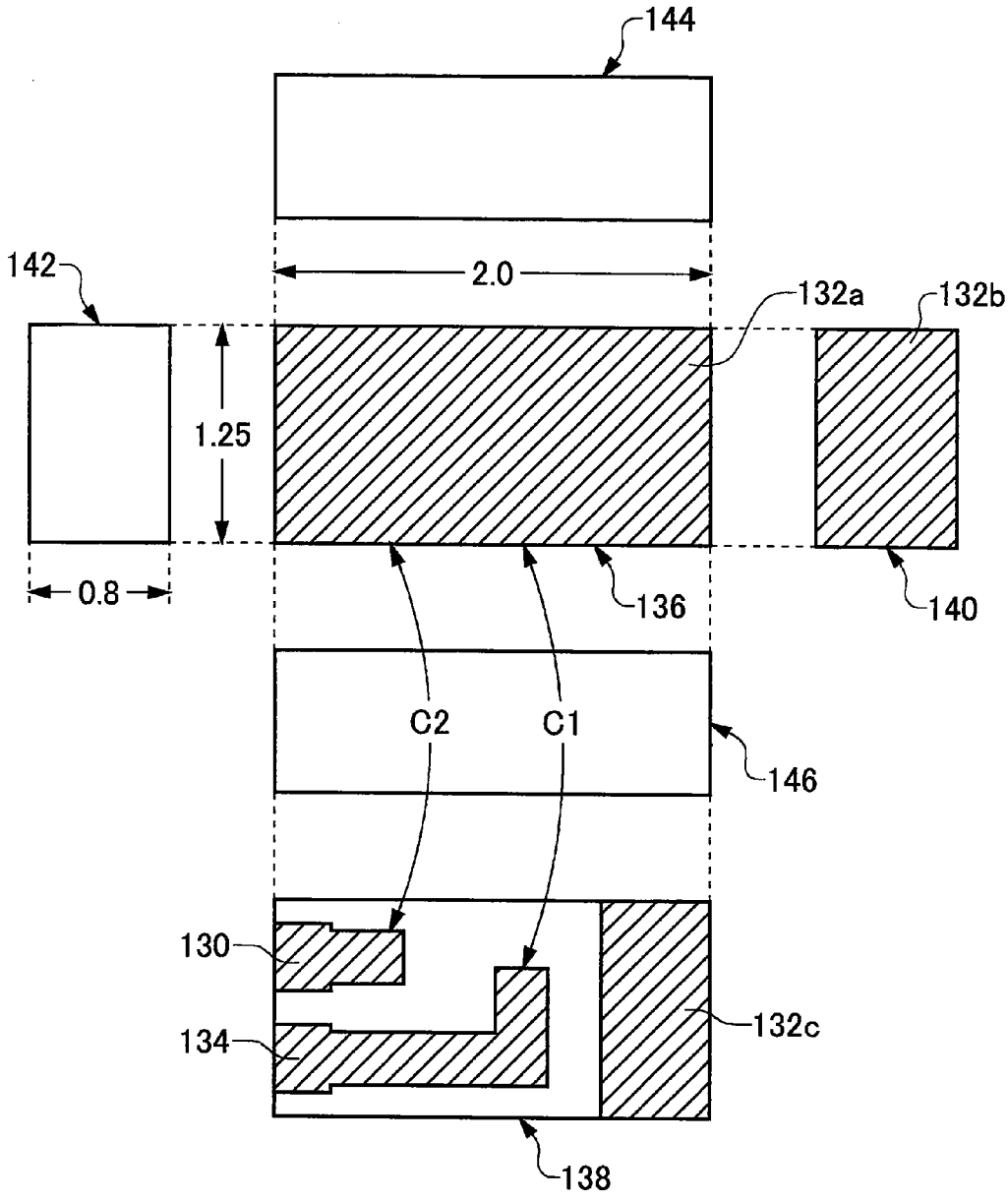
FIG. 2 is a development view of an antenna element in the first embodiment.

FIG. 2 is a development view of the antenna element 124 in the first embodiment. A structure of the antenna element 124 will be described with reference to FIGS. 1 and 2. The antenna element 124 has a dielectric body having substantially a rectangular solid shape as a base body, on the surface of which a feeding electrode 130, a radiation electrode 132, and a ground electrode 134 are printed. A rectangular bottom surface 138 (1.25 mm×2.0 mm) is bonded to the mounting area 104 and, thereby, the antenna element 124 is fixed to the printed board 122. The four side surfaces of the antenna element 124 are referred to respectively as a first side surface 140 (1.25 mm×0.8 mm), a second side surface 142 (1.25 mm×0.8 mm), a third side surface 144 (2.0 mm×0.8 mm), and a fourth side surface 146 (2.0 mm×0.8 mm). The fourth side surface 146 is a surface situated on the peripheral side of the printed board 122, and the third side surface 144 is a surface situated on the inner side of the same.

The radiation electrode 132 is printed on an upper surface 136, the first side surface 140, and the bottom surface 138 in a folded configuration. Hereinafter, the parts of the radiation electrode 132 that are printed on the upper surface 136, first side surface 140, and bottom surface 138 are referred to respectively as "radiation electrodes 132*a*, 132*b*, and 132*c*". The radiation electrode 132*a* is printed on the entire upper surface 136. The radiation electrode 132*b* is printed on the entire first side surface 140. The radiation electrode 132*c* is printed only on a part of the bottom surface 138.

The feeding electrode 130 and ground electrode 134 are also printed on the bottom surface 138. The feeding electrode 130 and ground electrode 134 extend partially in parallel to each other. The ground electrode 134 is formed into an L-shape that surrounds the feeding electrode 130 and extends partially in parallel to the radiation electrode 132*c*. The second side surface 142, third side surface 144, and fourth side surface 146 are each a non-electrode formation area. The open end (voltage point) of the ground electrode 134, that is, the leading end of the short arm of the L-shape faces the outer periphery of the printed board 122 (refer to FIG. 1). The reason for this is to keep the open end far away from the ground pattern area 103 so as to increase radiation resistance as much as possible.

The feeding electrode 130 is connected to the feeding pattern 106 and receives AC power from the feeding line 112. The ground electrode 134 is connected to the ground pattern area 103 having a ground potential through the second ground electrode connection pattern 110. The radiation electrode 132*c* is connected to the ground pattern area 103 through the first ground electrode connection pattern 108.

The ground electrode 134 and radiation electrode 132*a* face each other in terms of planes, so that ground coupling capacitance C1 is formed between the ground electrode 134 and radiation electrode 132*a*. Similarly, feeding coupling capacitance C2 is formed between the feeding electrode 130 and radiation electrode 132*a*. That is, the dielectric body itself forms a feeding gap. The resonance frequency of the antenna device 100 changes depending on the ground coupling capacitance C1. The impedance matching of the antenna device can be adjusted mainly by the feeding coupling capacitance C2.

Upon receiving power, the feeding electrode 130 generates an electric field, and AC current is generated in the radiation electrode 132*a* through the feeding coupling capacitance C2. This leads the radiation electrode 132 to generate radio waves.

The ground electrode 134 and radiation electrode 132*a* are opposed to each other as parallel planes, so that it is easy to ensure larger ground coupling capacitance C1 as compared to a case where the gap is formed in the upper surface or side surface of the dielectric body. Similarly, the feeding electrode 130 and radiation electrode 132*a* are opposed to each other as parallel planes, so that it is easy to increase the feeding coupling capacitance C2. The feeding electrode 130 and ground electrode 134 or ground electrode 134 and radiation electrode 132*c* are included on the same plane, so that influence of the capacitance generated between the above electrodes is negligibly small as compared to the ground coupling capacitance C1 and feeding coupling capacitance C2.

The magnitude of the ground coupling capacitance C1 can be adjusted depending on the area of the ground electrode 134 or height of the antenna element 124. For example, a procedure may be adopted in which the ground coupling capacitance C1 is roughly adjusted depending on the height of the antenna element 124 first, and then it is finely adjusted depending on the area of the ground electrode 134. Similarly, the magnitude of the feeding coupling capacitance C2 can be adjusted depending on the area of the feeding electrode 130 or height of the antenna element 124. For example, a procedure may be adopted in which the feeding coupling capacitance C2 is roughly adjusted depending on the height of the antenna element 124 first, and then it is finely adjusted depending on the area of the feeding electrode 130.

The ground coupling capacitance C1 or feeding coupling capacitance C2 is changed by changing the area (shape) of the ground electrode 134 or feeding electrode 130, so that it is easier to extend the adjustable range of the coupling capacitance than in the case where the width of the feeding gap is adjusted to adjust the coupling capacitance. As a result, it is possible to adjust antenna characteristics only by means of the antenna element 124 precisely without excessively depending on so-called a (external) matching element for use in adjustment of impedance or resonance frequency.

The mounting area 104 is often formed in the corner portion of the printed board 122. This is because that it is easier to suppress return loss than in the case where the antenna element 124 is formed in the side edge portion of the printed board 122. In the case of the antenna element 124 in the first embodiment, the ground coupling capacitance C1 and feeding coupling capacitance C2 can be adjusted widely, making it easy to realize low return loss and high radiation efficiency. As a result, even when the mounting area 104 is formed in the side edge portion, e.g., the center of the long side of the printed board 122, practical performance can be achieved.

In the antenna element 124, the electrode patterns of the surfaces other than the bottom surface 138 are extremely simple. Further, electrode pattern of the bottom surface 138 is not so complicated. This allows easy production of the antenna element 124, easily leading to quality stabilization.

Figure 3:
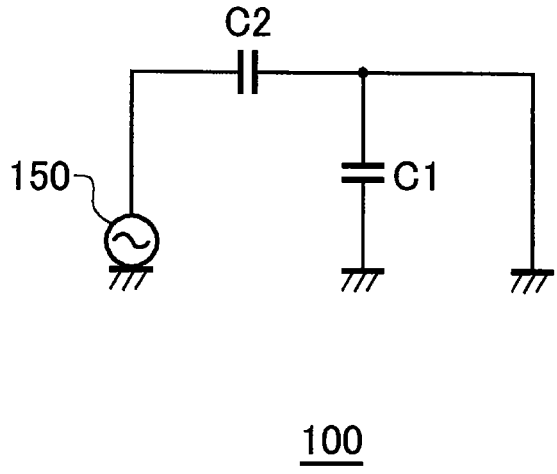
FIG. 3 is an equivalent circuit diagram of the antenna device.

FIG. 3 is an equivalent circuit diagram of the antenna device 100. AC power source 150 is a feeding source that feeds AC current to the feeding pattern 106 and feeding electrode 130.

Figure 4:
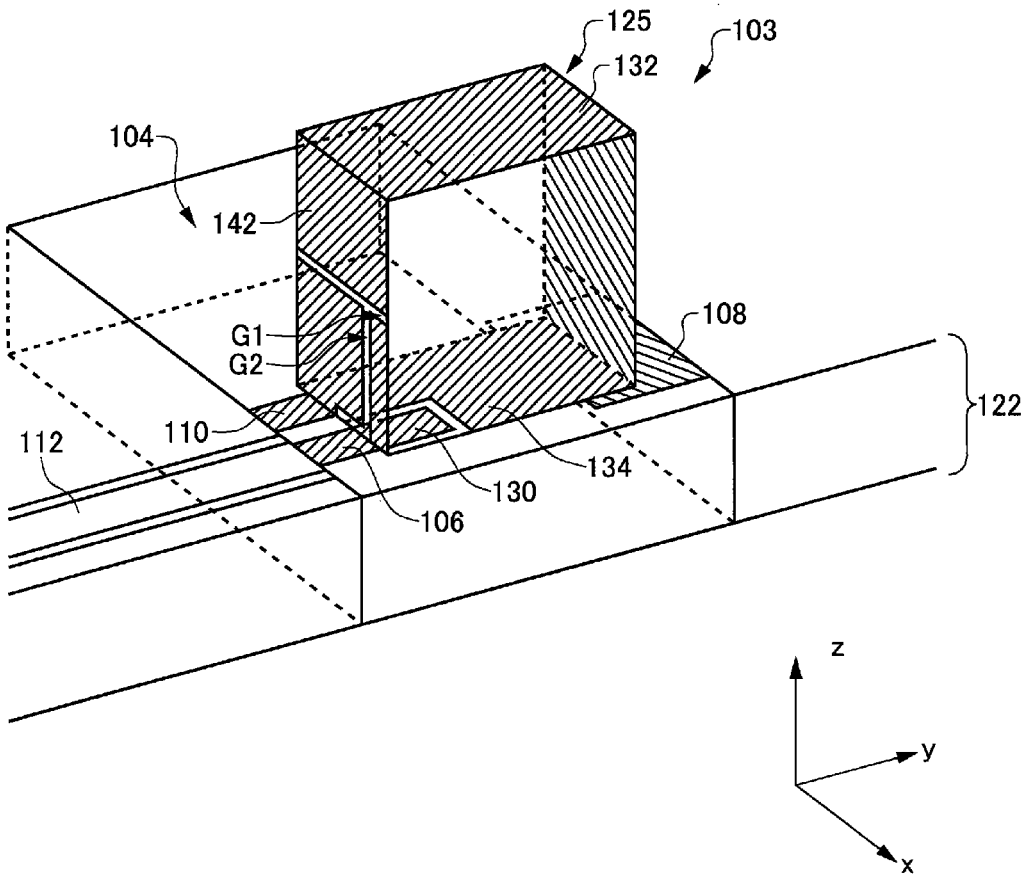
FIG. 4 is an outer appearance of an antenna device in a comparative example.

FIG. 4 is an outer appearance of an antenna device 105 in a comparative example. The antenna device 105 illustrated in the comparative example is obtained by a simulation based on the assumption that an antenna element having a configuration illustrated in FIG. 4 of Patent Document 1 is used in 2.45 GHz frequency band. Unlike the antenna element 124 (hereinafter, referred to also as "first type") of the antenna device 100 in the first embodiment, an antenna element 125 (hereinafter, referred to also as "side-gap type") of the antenna device 105 of the comparative example has gaps G1 and G2 formed on a second side surface 142. As a result of a simulation performed with the x-direction size and y-direction size of the antenna device 125 fixed to the same dimensions as those of the antenna element 124, the obtained size of the antenna element 125 was 1.25 mm×2.0 mm×2.0 mm (x×y×z). That is, the height of the antenna element is increased as compared to the first type. The width of the gap G1 was 0.01 mm, and the width of the gap G2 was 0.04 mm, making the actual production of the antenna element difficult.

Figure 5:
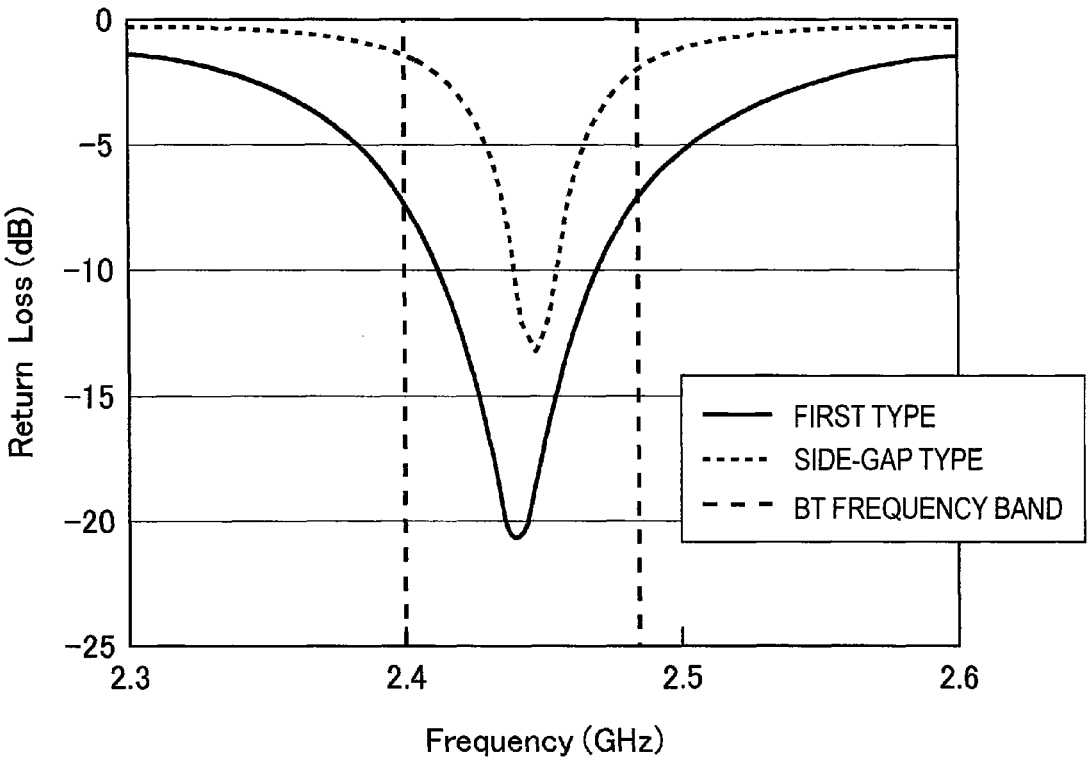
FIG. 5 is a graph illustrating a comparison between a first type and side-gap type in terms of a relationship between return loss and frequency.

FIG. 5 is a graph illustrating a comparison between the first type and side-gap type in terms of a relationship between the return loss and frequency. It is assumed here that the relative permittivity of the base bodies (dielectric bodies) of both the antenna elements 124 and 125 be 37. Further, it is assumed that the feeding electrode 130, radiation electrode 132, and ground electrode 134 be made of copper (Cu). As illustrated in FIG. 5, in the Bluetooth® frequency band, the return loss of the first type is considerably smaller than that of the side-gap type.

Figure 6:
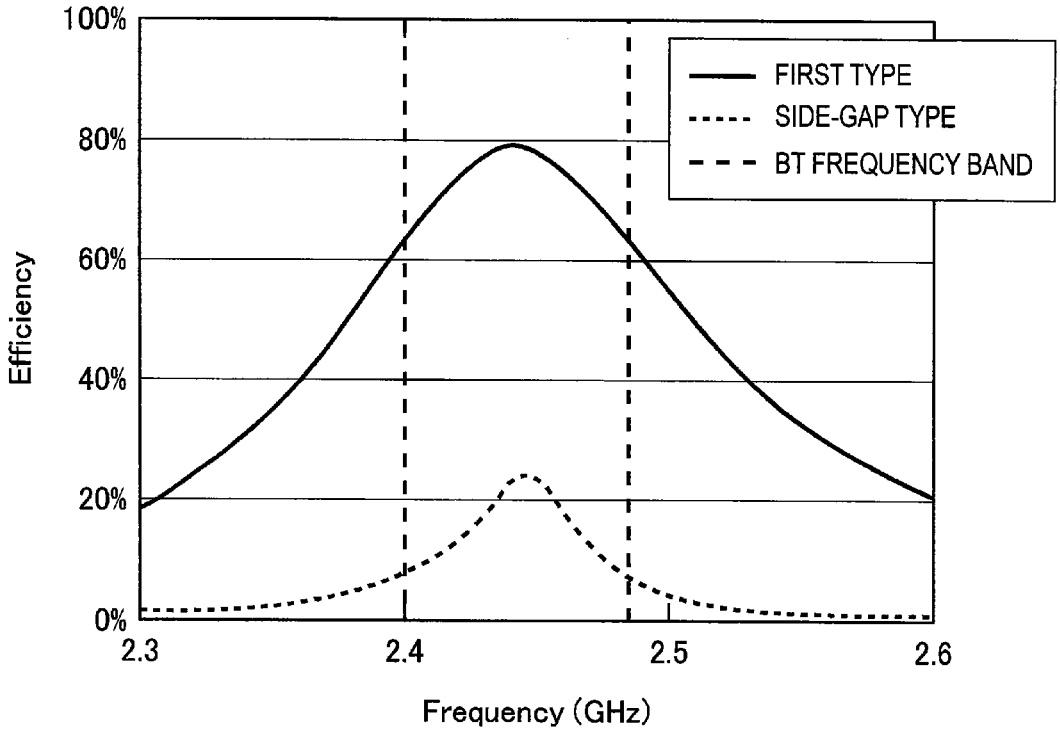
FIG. 6 is a graph illustrating a comparison between the first type and side-gap type in terms of a relationship between radiation efficiency and frequency.

FIG. 6 is a graph illustrating a comparison between the first type and side-gap type in terms of a relationship between the radiation efficiency and frequency. The radiation efficiency is considerably improved in the first type as compared to in the side-gap type. The maximum radiation efficiency of the first type was 78.6(%), and maximum radiation efficiency of the side-gap type was 23.2(%). That is, in the case where the first type is used, the maximum radiation efficiency is improved by 55.4(%) (=78.6−23.2).

Figure 7:
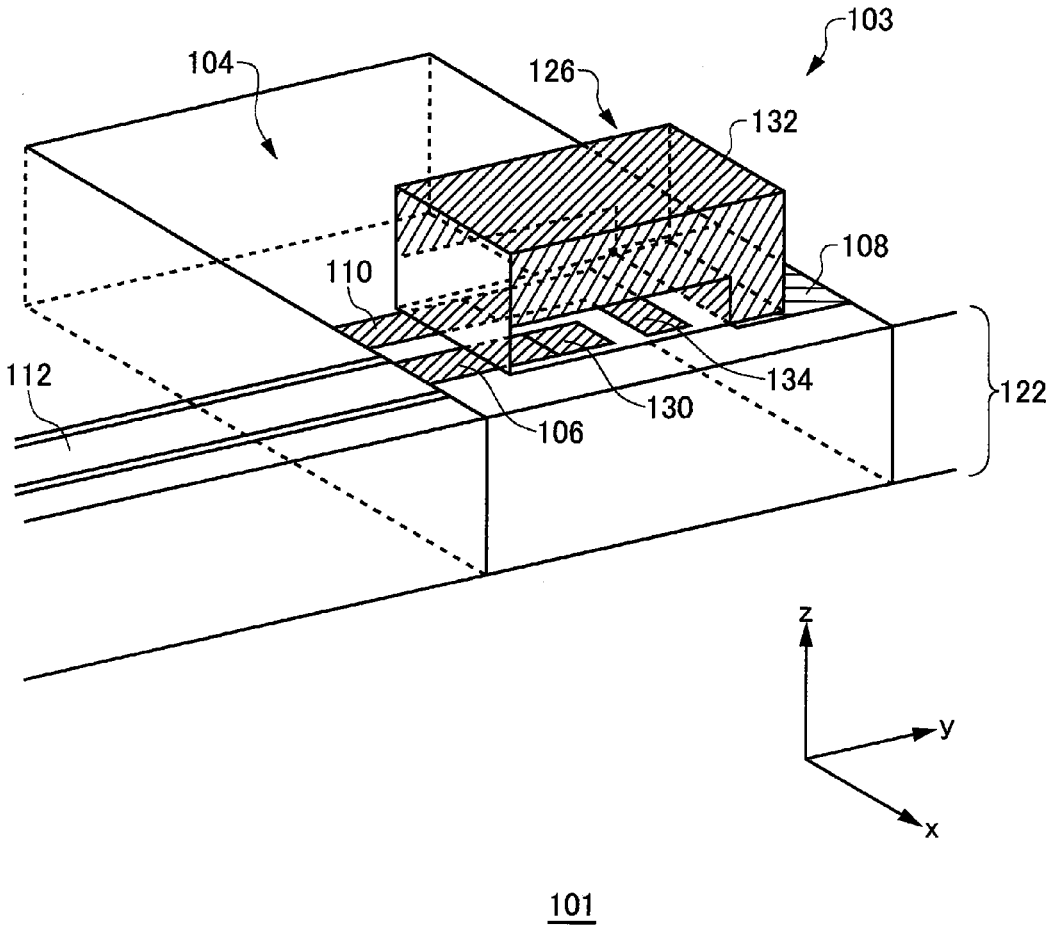
FIG. 7 is an outer appearance of an antenna device in a second embodiment.

FIG. 7 is an outer appearance of an antenna device 101 in a second embodiment. Unlike the case of first type, in an antenna element 126 (hereinafter, referred to as "second type") of the antenna device 101 in the second embodiment, the radiation electrode 132 is formed also in the upper portions (upper surface 136 side) of the third and fourth side surfaces 144 and 146. The area of the radiation electrode 132 is thus increased in effect, which easily leads to reduction of VSWR (Voltage Standing Wave Ratio).

Figure 8:
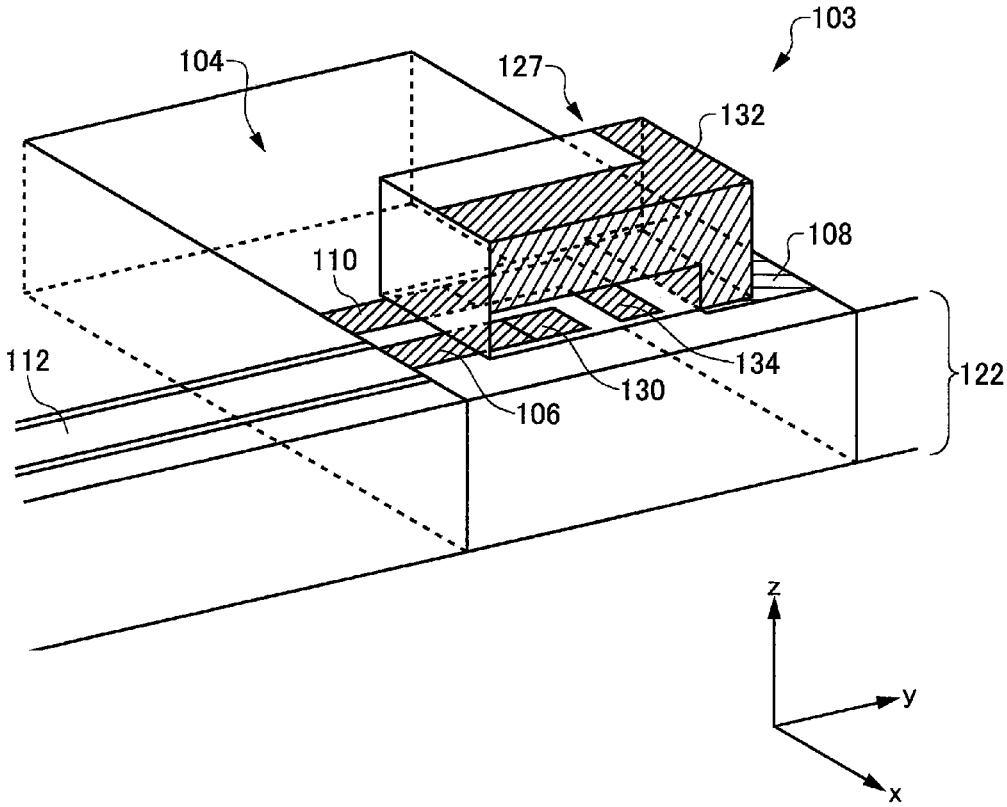
FIG. 8 is an outer appearance of an antenna device in a third embodiment.

FIG. 8 is an outer appearance of an antenna device 102 in a third embodiment. In an antenna element 127 (hereinafter, referred to also as "third type") of the antenna device 102 in the third embodiment, the radiation electrode 132 is formed in the upper portion (upper surface 136 side) of the fourth side surface 146 and the outer peripheral side (fourth side surface 146 side) of the upper surface 136. When the distance (hereinafter, referred to as "ground distance") between the radiation electrode 132 and ground pattern area 102 is small, electromagnetic coupling (hereinafter, referred to as "ground coupling") between the radiation electrode 132 and ground pattern area 102 easily becomes obvious. When the ground coupling becomes large, radiation resistance becomes smaller, easily leading to degradation of the radiation efficiency. Since the main part of the radiation electrode 132 is formed in the outer peripheral side of the upper surface 136 and upper portion of the fourth side surface 146 in the third type, a sufficient ground distance can be ensured.

Figure 9:
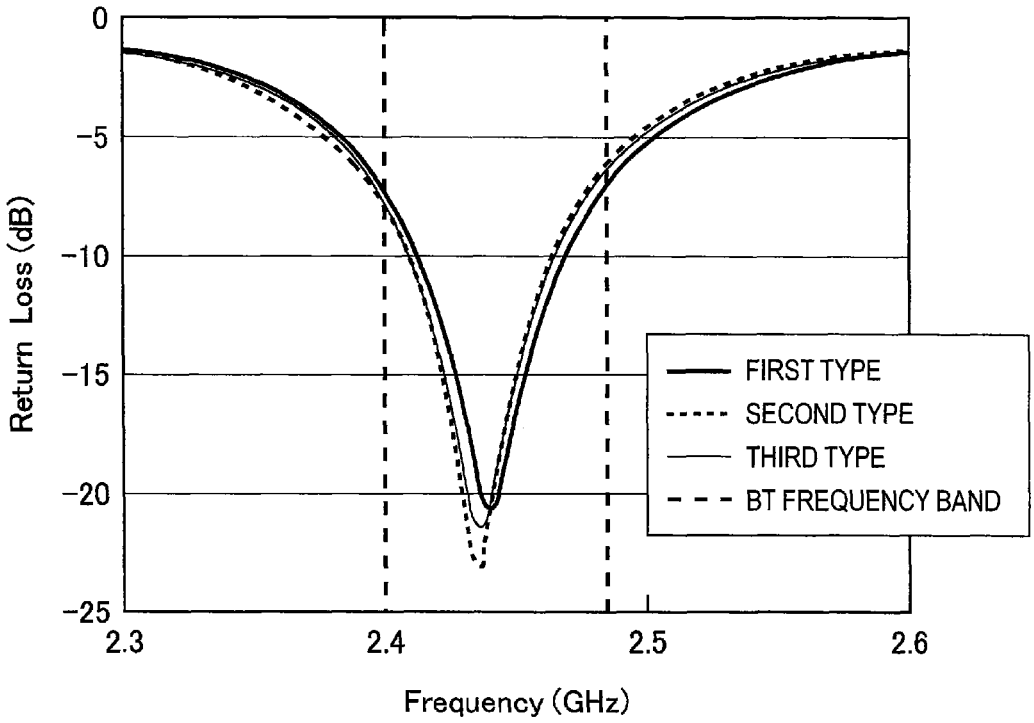
FIG. 9 is a graph illustrating a comparison between the first, second, third types in terms of a relationship between return loss and frequency.

FIG. 9 is a graph illustrating a comparison between the first, second, third types in terms of a relationship between the return loss and frequency. The return loss of the second and third types is smaller than that of the first type, but the difference therebetween is very small.

Figure 10:
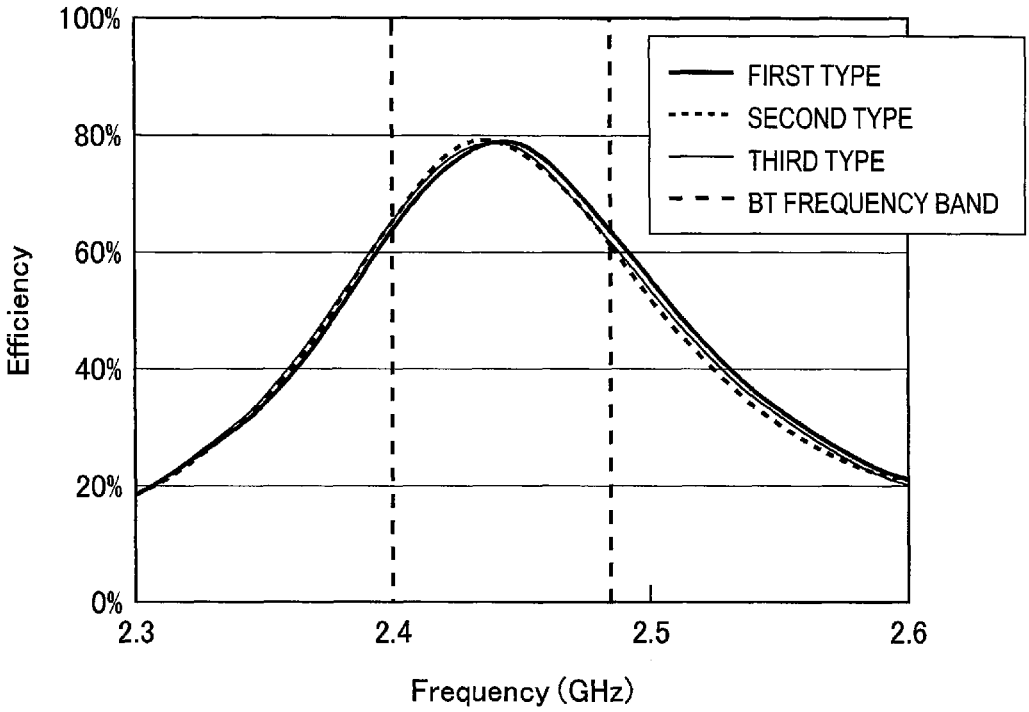
FIG. 10 is a graph illustrating a comparison between the first, second, and third types in terms of a relationship between radiation efficiency and frequency.

FIG. 10 is a graph illustrating a comparison between the first, second, and third types in terms of a relationship between the radiation efficiency and frequency. The maximum radiation efficiency of the first to third types is about 79(%), which means there is no significant difference. From the above, it was found that the first, second, and third types have equivalent antenna performance. The electrode pattern of the radiation electrode 132 is the simplest in the first type, so the first type can be said to be the most excellent of the three types in the viewpoint of manufacturability.

Figure 11:
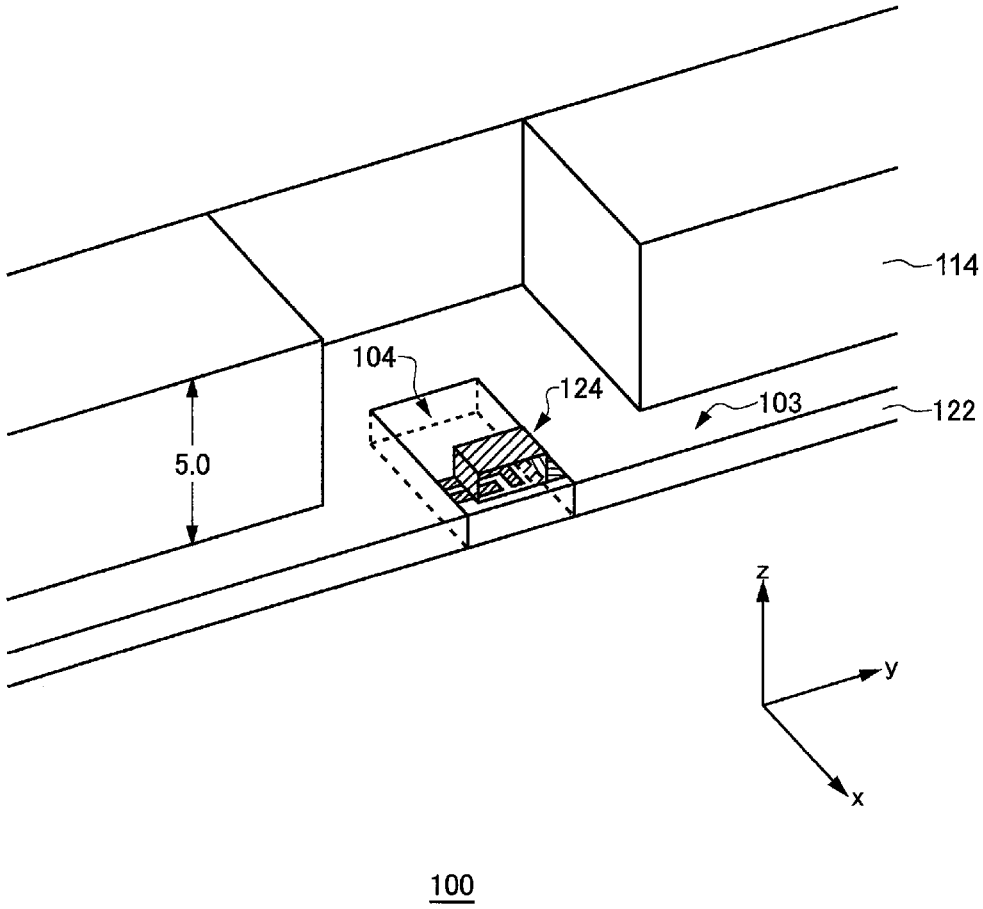
FIG. 11 is an outer appearance of the antenna device in which a mounting area is surrounded by a metal body.
Figure 12:
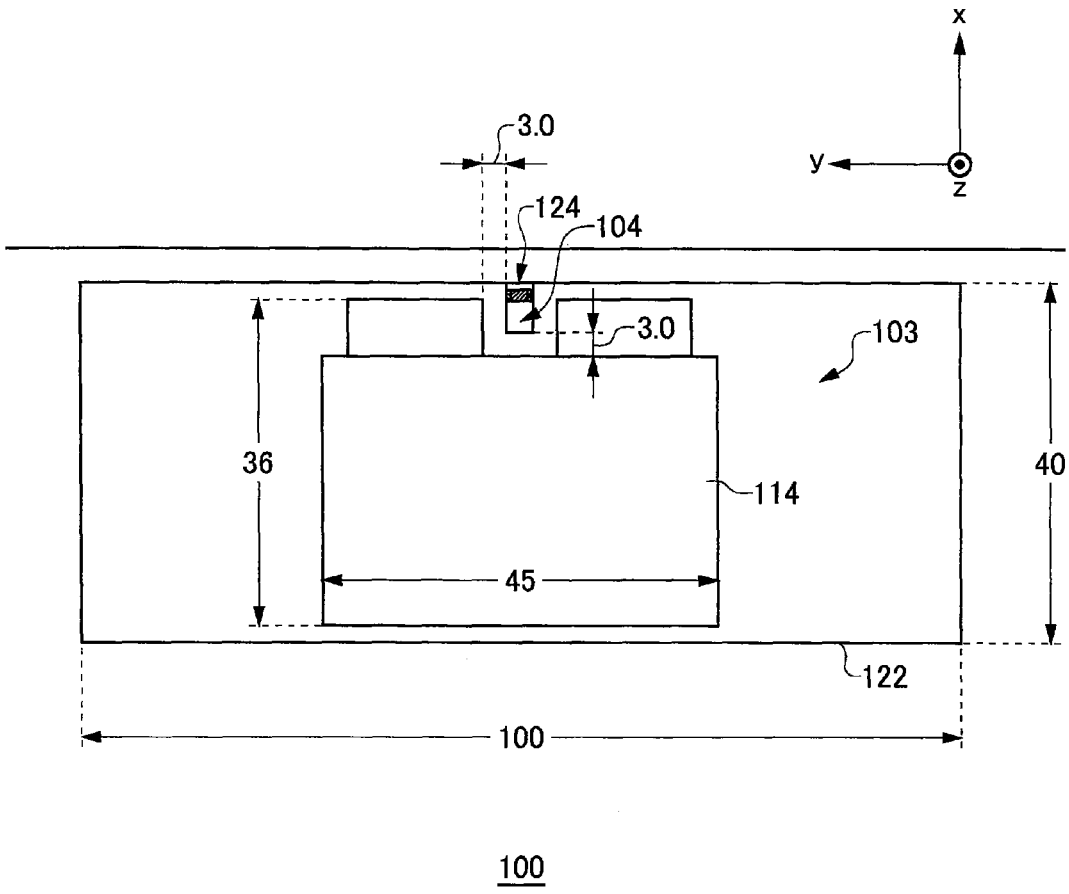
FIG. 12 is a top view of the antenna device in which the mounting area is surrounded by the metal body.

FIG. 11 is an outer appearance of the antenna device 100 in which the mounting area 104 is surrounded by a metal body 114, and FIG. 12 is a top view of FIG. 11. In the second type, the third and fourth side surfaces 144 and 146 are each partly covered by the radiation electrode 132, so that shielding effectiveness is expected to be achieved in the second type. That is, an assumption is made for the second type that the radiation electrode 132 of the side surface portion effectively protects the feeding electrode 130 or ground electrode 134 from external influences. In order to verify this assumption, a simulation was carried out to estimate antenna characteristics obtained in the configuration in which the metal body 114 is installed around the mounting area 104. The use of the metal body 114 is based on the assumption that a battery, an LCD (Liquid Crystal Display), a shield case, a metal frame, or other electronic components are installed in that portion. The size of the metal body 114 is 36 mm×45 mm×5.0 mm (x×y×z). As a distance between the mounting area 104 and metal body 114, a distance of 3.0 mm is ensured in both x- and y-directions.

Figure 13:
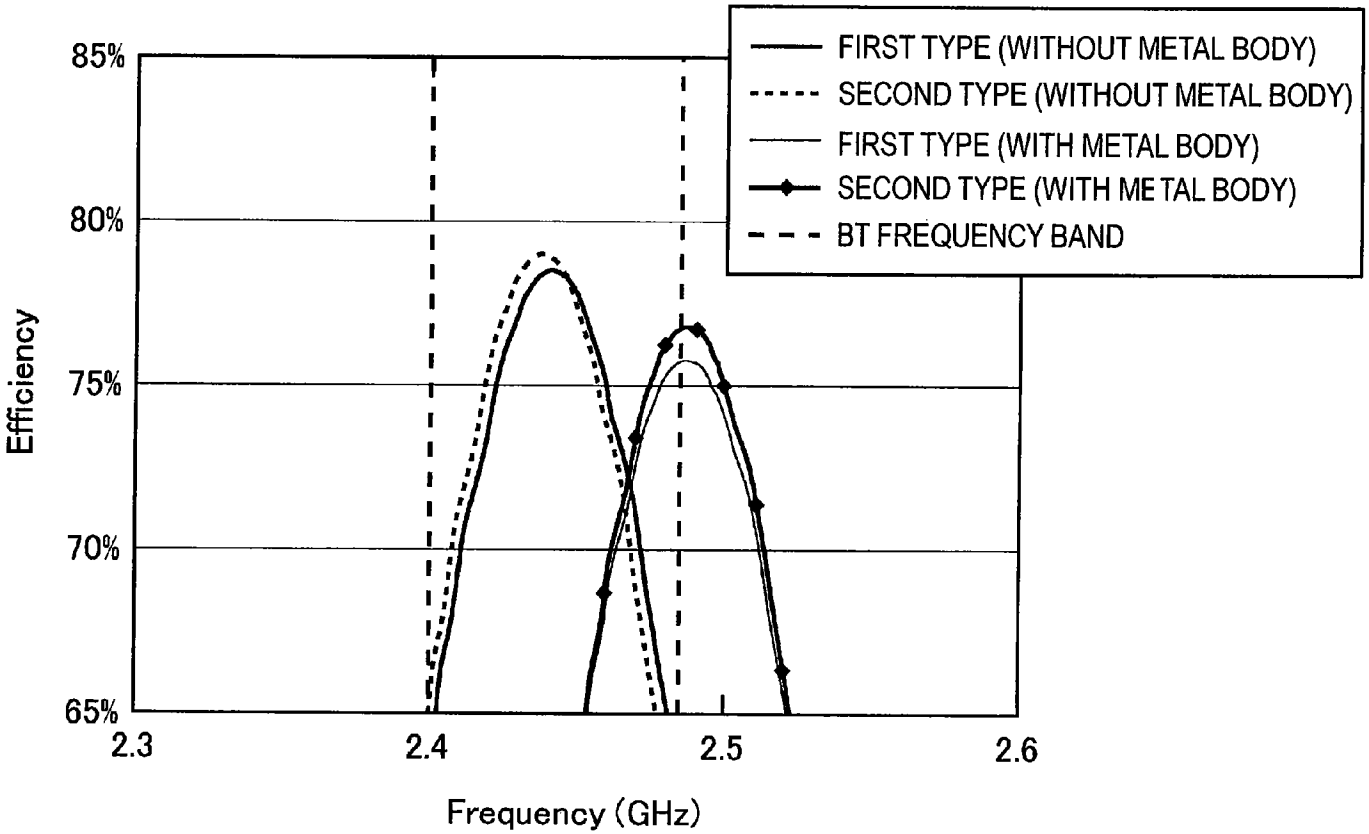
FIG. 13 is a graph illustrating a comparison between the first and second types in terms of relationships between the radiation efficiency and frequency exhibited when the metal body is installed and when not.

FIG. 13 is a graph illustrating a comparison between the first and second types in terms of relationships between the radiation efficiency and frequency exhibited when the metal body 114 is installed and when not. Unlike the case of FIG. 10, FIG. 13 represents frequency characteristics around the maximum radiation efficiency. In the case where the metal body 114 was not installed, the maximum radiation efficiencies in the first and second types were 78.6(%) and 78.9(%) respectively, which means there is little difference. In the case where the metal body 114 was installed, the maximum radiation efficiencies in the first and second types were 75.7(%)

and 76.8(%) respectively. That is, in the case of the first type, installation of the metal body 114 reduces the maximum radiation efficiency by 2.9(%) (=78.6−75.7), while in the case of the second type, the maximum radiation efficiency is reduced by 2.1(%) (=78.9−76.8). That is, the second type is less subject to the influence of the metal body than the first type, which verifies the above assumption.

The antenna devices 100, 101, and 102 have been described based on the respective embodiments. In every embodiment, the feeding electrode 130 and ground electrode 134 of the bottom surface 138 are opposed to the radiation electrode 132*a* of the upper surface 136 as parallel planes, so that it is possible to easily increase the ground coupling capacitance C1 and feeding coupling capacitance C2. The second side surface 142 is made to act as a fully open end, and no feeding gap is formed on any of the surfaces of the antenna element 124. The ground coupling capacitance C1 or feeding coupling capacitance C2 changes depending on the area of the feeding electrode 130 or ground electrode 134. Therefore, it is possible to significantly change antenna characteristics only by means of the electrode patterns formed on the antenna element. Further, the simplicity of the electrode patterns enhances manufacturability and contributes to cost reduction and quality stabilization.

In the case where antenna characteristics are adjusted using an inductor, the radiation efficiency can be reduced by the resistance component of the inductor. However, in the case of the antenna element according to the present embodiment, both the resonance frequency and impedance can be adjusted by a capacitance (ground coupling capacitance C1, feeding coupling capacitance C2), eliminating the need of forming the inductance using the electrode pattern.

The present invention has been described based on the above embodiments. It should be understood by those skilled in the art that the above embodiments are merely exemplary of the invention, various modifications and changes may be made within the scope of the claims of the present invention, and all such variations may be included within the scope of the claims of the present invention. Thus, the descriptions and drawings in this specification should be considered as not restrictive but illustrative.

What is claimed is:

1. An antenna device comprising:

an antenna element, which includes a dielectric body having substantially a rectangular solid shape on the surfaces of which a radiation electrode, a feeding electrode, and a ground electrode are formed; and a printed board including a mounting area in which the antenna element is mounted and a ground pattern area formed around the mounting area, wherein both the feeding electrode and the ground electrode are formed only on the bottom surface of the dielectric body, the radiation electrode is formed on the upper surface of the dielectric body, a first side surface thereof, and bottom surface thereof in a folded configuration, a second side surface opposite to the first side surface is configured as a non-electrode formation area, and a part of the radiation electrode is formed on the upper part of both or one of the third and fourth side surfaces adjacent to the first and second side surfaces.

2. The antenna device according to claim 1, wherein the radiation electrode is formed on the entirety of the upper surface.

3. The antenna device according to claim 1, wherein the radiation electrode is formed on the entirety of the first side surface.

4. The antenna device according to claim 1, wherein the ground electrode is formed as to be opposed to the radiation electrode with a gap having a predetermined width interposed therebetween on the bottom surface.

* * * * *